US011491777B2

(12) United States Patent
Yardley

(10) Patent No.: US 11,491,777 B2
(45) Date of Patent: Nov. 8, 2022

(54) SCREEN PRINTING DEVICE

(71) Applicant: Livingston Systems, LLC, Denver, CO (US)

(72) Inventor: Ronald Joseph Yardley, Hermosa Beach, CA (US)

(73) Assignee: Livingston Systems, LLC, Denver, CO (US)

( * ) Notice: Subject to any disclaimer, the term of this patent is extended or adjusted under 35 U.S.C. 154(b) by 0 days.

(21) Appl. No.: 17/451,690

(22) Filed: Oct. 21, 2021

(65) Prior Publication Data

US 2022/0126564 A1 Apr. 28, 2022

Related U.S. Application Data

(60) Provisional application No. 63/198,498, filed on Oct. 23, 2020.

(51) Int. Cl.

| | |
|---|---|
| ***B41J 3/407*** | (2006.01) |
| ***B41F 15/22*** | (2006.01) |
| ***B41F 15/42*** | (2006.01) |
| ***B41F 15/26*** | (2006.01) |
| ***B41F 15/44*** | (2006.01) |

(52) U.S. Cl.

CPC ..... *B41F 15/22* (2013.01); *B41F 15/26* (2013.01); *B41F 15/42* (2013.01); *B41F 15/44* (2013.01); *B41J 3/4078* (2013.01)

(58) Field of Classification Search

CPC ..... B41F 15/22; B41F 15/26

See application file for complete search history.

(56) References Cited

U.S. PATENT DOCUMENTS

| | | | | |
|---|---|---|---|---|
| 3,783,073 | A | 1/1974 | Wamberg | |
| D246,083 | S | 10/1977 | Auersperg | |
| 4,058,055 | A | 11/1977 | Douglas | |
| 4,287,826 | A | 9/1981 | Brabec | |
| 4,753,164 | A * | 6/1988 | Barnes | B41F 15/04 108/143 |
| 4,819,559 | A | 4/1989 | Szarka | |
| 4,846,058 | A * | 7/1989 | Farris | B41M 1/12 101/DIG. 36 |

(Continued)

FOREIGN PATENT DOCUMENTS

WO WO-2020227311 A1 * 11/2020

OTHER PUBLICATIONS

"Tag Along" dated Oct. 18, 2014, Available from the Internet at https://www.youtube.com/watch?v=-3KWYB9gmLAat least as early as May 5, 2016.

(Continued)

*Primary Examiner* — Matthew G Marini
*Assistant Examiner* — Marissa Ferguson-Samreth
(74) *Attorney, Agent, or Firm* — Trenner Law Firm, LLC; Mark D. Trenner

(57) ABSTRACT

A screen printing device is disclosed for printing in a label area. An example screen printing device includes a printing pallet having a chest image printing surface connected to a label printing surface. The label printing surface extends outside of a chest image printing area of a printing machine when the screen printing pallet is loaded onto the printing machine. An example screen printing device includes an offset squeegee configured for a printing operation by the printing machine on the label printing surface.

20 Claims, 18 Drawing Sheets

(56) References Cited

U.S. PATENT DOCUMENTS

| | | | | |
|---|---|---|---|---|
| 4,908,912 | A | 3/1990 | Grant | |
| 4,930,413 | A | 6/1990 | Jaffa | |
| 5,107,758 | A * | 4/1992 | Withers | B41F 15/18 101/35 |
| 5,161,466 | A * | 11/1992 | Burris | B41F 17/005 101/474 |
| 5,226,362 | A * | 7/1993 | Iaccino | G03F 9/00 101/127 |
| 5,247,885 | A | 9/1993 | Iaccino | |
| 5,327,827 | A | 7/1994 | Richardson | |
| 6,631,985 | B2 | 10/2003 | Koizumi | |
| 6,640,714 | B1 * | 11/2003 | Papa | B41F 15/0863 101/474 |
| 6,651,554 | B1 | 11/2003 | Williams | |
| 7,413,301 | B2 | 8/2008 | Niimi | |
| D648,784 | S | 11/2011 | Horito | |
| D702,529 | S | 4/2014 | Diez Herrera | |
| 9,302,462 | B2 * | 4/2016 | Livingston | B41F 15/28 |
| D765,775 | S | 9/2016 | Livingston | |
| 9,849,665 | B2 | 12/2017 | Livingston | |
| 2004/0000240 | A1 | 1/2004 | Oleson | |
| 2004/0189776 | A1 | 9/2004 | Niimi | |
| 2005/0278984 | A1 | 12/2005 | Kenney | |
| 2006/0203069 | A1 * | 9/2006 | Niimi | B41J 3/4078 347/104 |
| 2013/0057632 | A1 | 3/2013 | Moriya | |
| 2013/0336702 | A1 | 12/2013 | Yanagishita | |
| 2015/0360460 | A1 | 12/2015 | Livingston | |
| 2018/0072044 | A1 | 3/2018 | Livingston | |
| 2018/0333949 | A1 * | 11/2018 | Edwards | B41F 17/005 |

OTHER PUBLICATIONS

Screenshots of website http://littlesistersystem.com/ and corresponding videos linked from this website. Videos uploaded Feb. 18, 2013 and May 25, 2009, respectively, 3 pages total.

* cited by examiner

SCREEN PRINTING DEVICE

PRIORITY CLAIM

This application claims the priority benefit of U.S. Provisional Patent Application No. 63/198,498 filed Oct. 23, 2020 titled "Screen Printing Device" of Ronald Joseph Yardley, hereby incorporated by reference in its entirety as though fully set forth herein.

BACKGROUND

A printing machine can print an image (e.g., words and/or graphics) on a shirt loaded onto a standard screen printing pallet (or platen) with a screen frame in a printing space of about 16 inches wide by about 19 inches tall on a shirt. With current pallets (e.g., the pallets disclosed in U.S. Pat. No. 9,302,462), the tag or label printing area and gap in the pallet reduces the image height on the chest of the shirt down to about 13 inches tall. This is a loss of about 6 inches of printing space.

DETAILED DESCRIPTION

An example screen printing device is disclosed herein which implements a longer pallet that can be loaded onto the printing machine so that the label (or "tag") print area is outside of the chest image printing area. Positioning the label printing area in this manner enables separate printing operations for printing the label and the chest image without reducing the image height on the chest of the shirt. The shirt can be moved between station(s) of the printing machine. For example, printing operations in the chest image area may be at one station, and printing operations in the label or tag area may be at another station.

The example printing device may include an offset squeegee and an offset flood bar configured for printing with the longer pallet. The offset squeegee and the offset flood bar may be installed on one of the print heads (e.g., at a label or tag printing station) of the printing machine for printing in the label or tag area of the shirt.

In an example, the offset squeegee and the offset flood bar may be implemented with a new printing machine specifically configured for use with these components. In another example, an already existing printing machine may be retrofitted to operate with the offset squeegee and offset flood bar. For example, a rail may be provided to mount the offset squeegee and the offset flood bar on an existing printing machine.

In an example, the stroke of the squeegee and flood bar may be offset (relative to the other printheads of a screen printing machine). For example, the start and/or stop position may be farther out on the pallet to print in the tag area on the longer platten. In another example, one or more stations on the screen printing machine may be provided with an extended stroke (e.g., same start position but stops farther out) to print in the tag area on the longer platten.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

Figure 1:
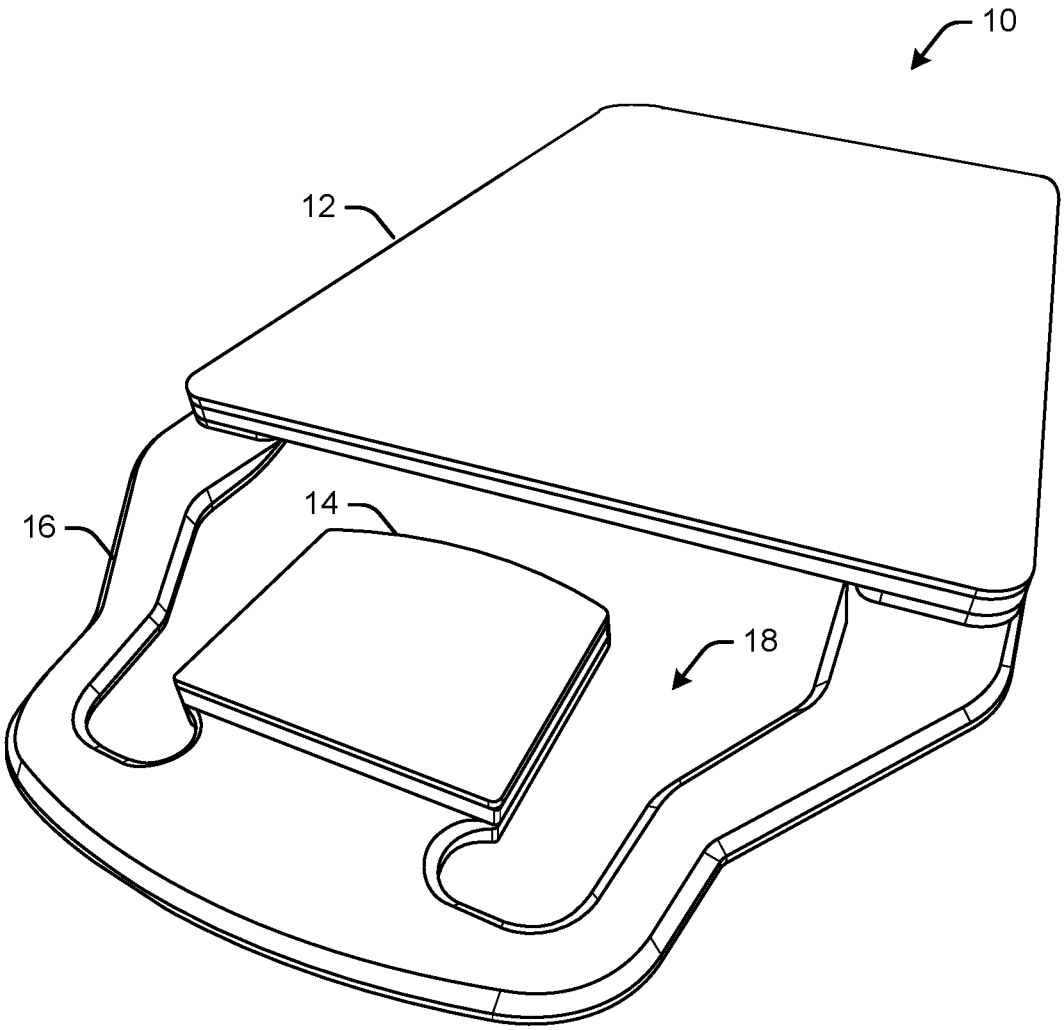
FIGS. 1-3 show an example printing pallet or platen for a screen printing device.
Figure 2:
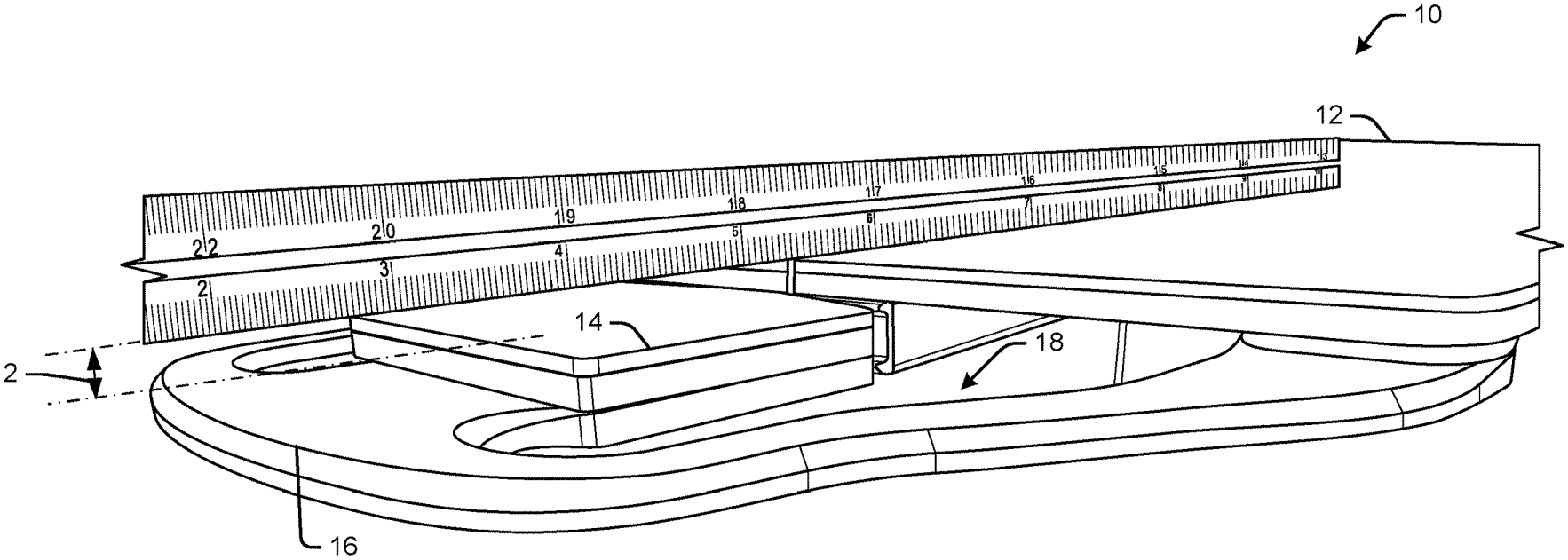
Figure 3:
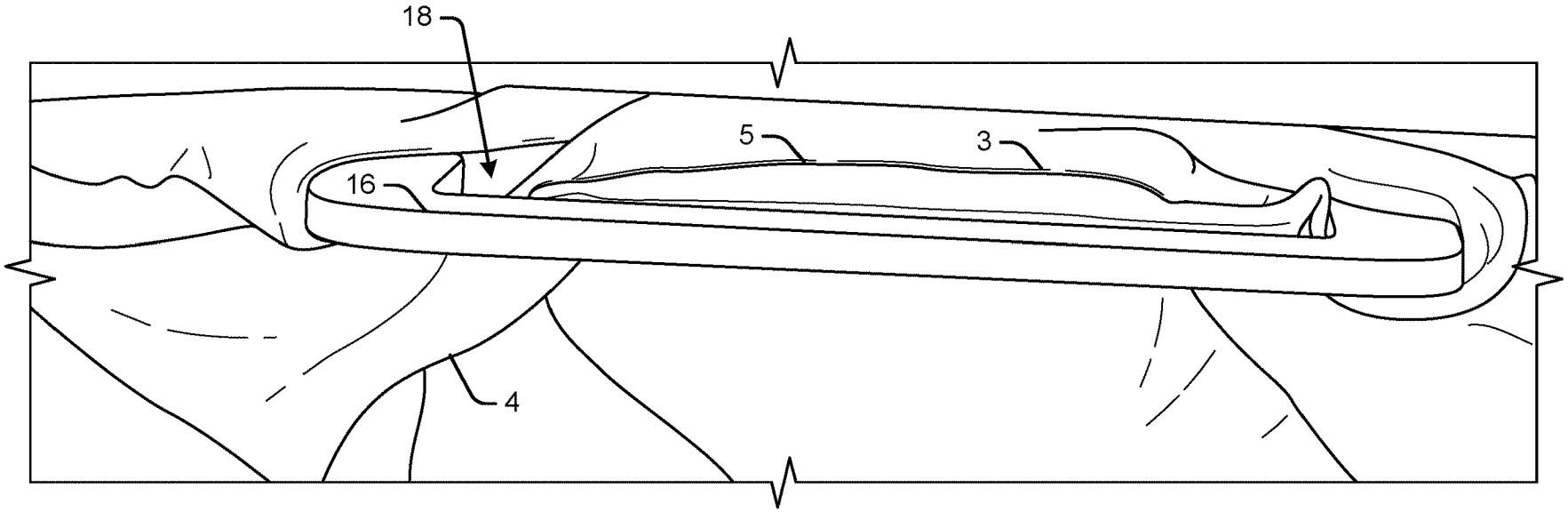

FIGS. 1-3 show an example printing pallet (or platen) 10 for a screen printing device (see, e.g., FIGS. 10-17). An example screen printing device includes a printing pallet or platen 10 having a chest image printing surface 12 and a label printing surface 14.

In an example, the chest image printing surface 12 is connected to the label printing surface 14, e.g., by connecting member 16. An opening 18 is formed between the connecting member 16 and the label printing surface so that a neck or collar area 3 of a shirt 4 is able to be fed through the opening 18 with the label or tag area 5 on the inside back of the shirt 4 mounted facing up on the label printing surface 14 of the platen 10.

In an example, the platen 10 may be formed as a single unit having the chest image printing surface 12 and the label printing surface 14. In another example, the platen 10 may include separate components that are connected together.

In an example, the platen 10 has an upper plane corresponding to the top of chest image printing surface 12 (bottom edge of the straight edge 1 shown in FIG. 2), and a lower plane corresponding to the top of label printing surface 14. The printing area 14 is sufficiently lower than the main print surface 12 so that the printed label or tag area 3 on the shirt 4 (as seen in FIG. 3) remains on the lower plane after printing when the shirt 4 is moved to the next print station. In an example, the upper plane is about ⅛ inch higher than the lower plane (as illustrated by the distance between arrows 2 in FIG. 2). This helps prevent the shirt collar 5 from interfering with printing of the next screen (e.g., on the shirt body).

The difference in height between the two planes (illustrated by arrows 2 in FIG. 2) may also aid with clamping of the screen and frame to hold the screen and frame in place during a printing operation. For example, many higher-end screen printing machines traditionally clamp the screen and frame at the base or bottom portion of the shirt 4 and/or the top of the shirt 4 near the shirt collar. The label or tag printing area 14 at a lower plane than the main print surface 12 provides additional clearance when used with these print machines, for the clamps to instead be positioned on the sides of the shirt 4.

It is noted that for some print machines, the screen frame may already be clamped on the sides of the shirt 4. For other print machines, additional hardware may be installed on the print machine to change the clamping setup from a front/back clamp to a side clamp. For these print machines, using side clamps eliminates the need for a platen with a tag area on a lower plane. In these cases, the platen 10 may be provided with the offset or extended tag area, but need not have separate planes for the print surfaces 12 and 14.

Figure 4:
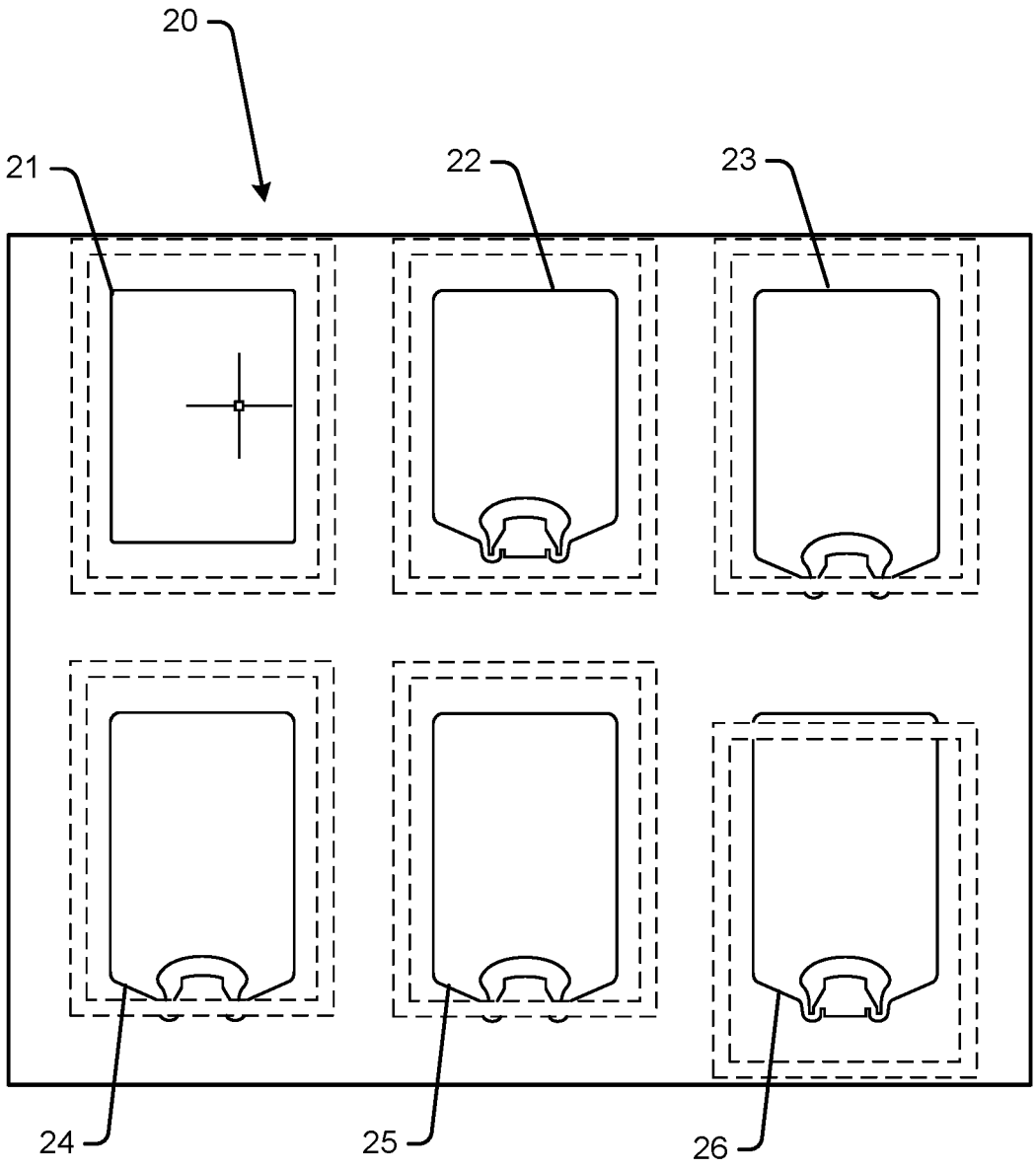
FIG. 4 shows example screen print areas of the screen printing device.

As noted above, the label printing surface 14 of the new platen 10 extends outside of a chest image printing area of a printing machine when the platen 10 is loaded onto a printhead or station of the printing machine. FIG. 4 shows example screen print areas 20. The dashed lines illustrate the frame that is clamped to the platen 10. Anything within the frame is printable space. Print area 21 illustrates a standard printing area of a printing machine. Print area 22 illustrates a print area with a shirt on a standard platen and mounted on the print machine.

Print areas 23-26 illustrate a shirt mounted on the longer pallet (e.g., pallet 10 shown in FIGS. 1-3). It can be seen how the tag or label printing area is blocked by the frame in print areas 23-25. However, the platen described herein may be mounted at one of the stations with an extended print area 26 so that printing in the label or tag area can be achieved by utilizing the offset squeegee and flood bar disclosed herein.

In an example, the offset squeegee and flood bar may be configured to provide an offset stroke for the printing operation. The offset stroke designates a travel path for the squeegee on the label printing surface during the printing operation on the first print station. For example, the offset stroke may have an offset start position and/or an offset stop position.

Figure 5:
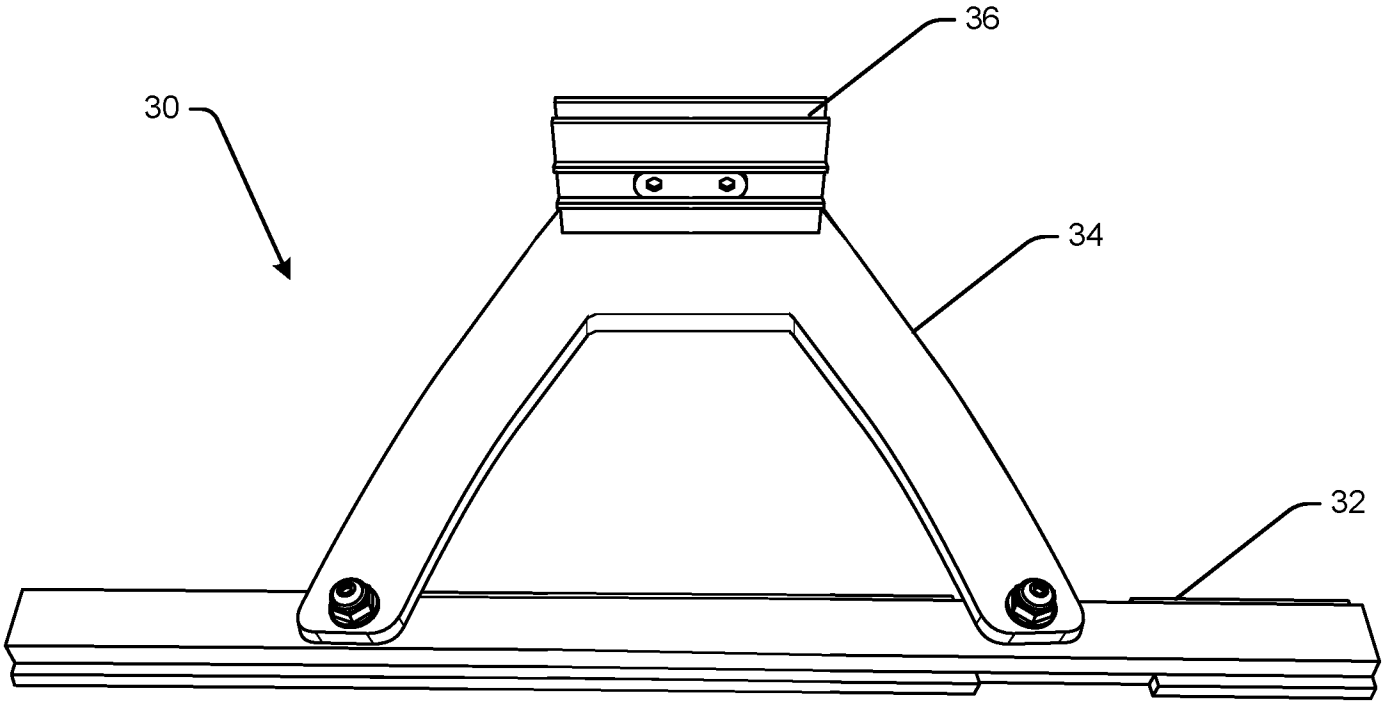
FIGS. 5-6 show an example offset squeegee of the screen printing device.
Figure 6:
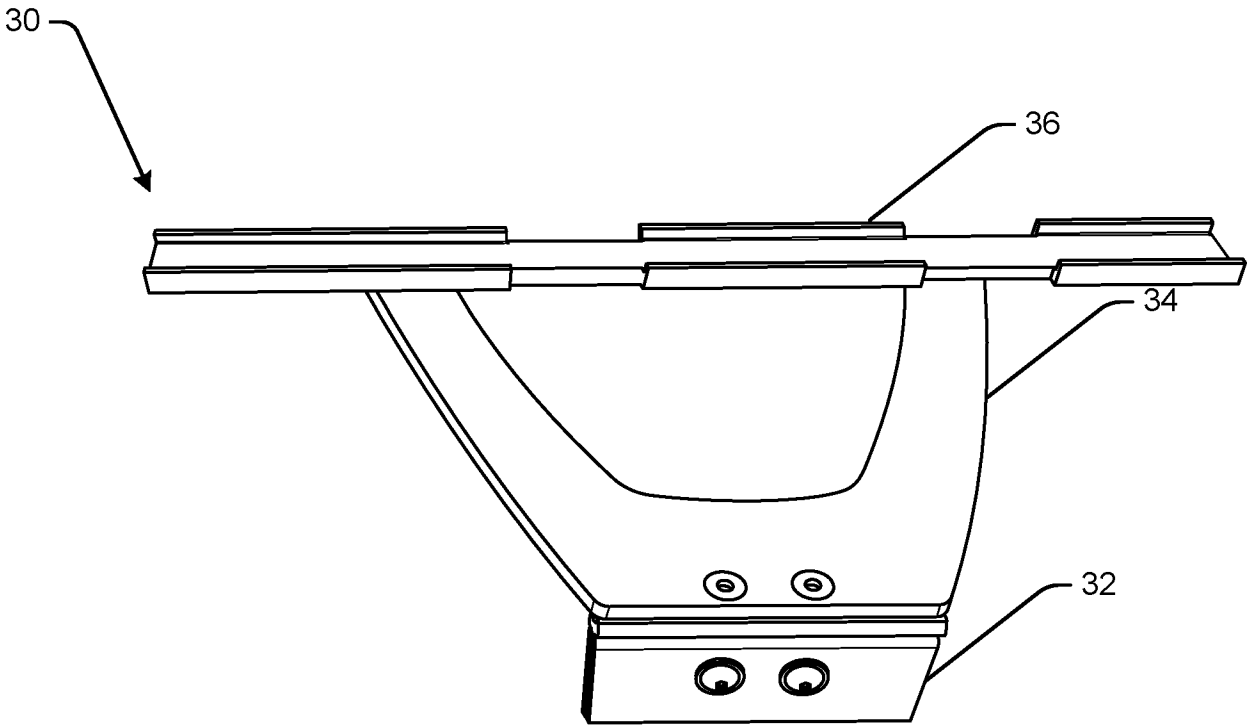

FIGS. 5-6 show an example offset squeegee 30 of the screen printing device. The example offset squeegee 30 has a mounting bar 32, offset bracket 34, and flexible squeegee portion 36. The example offset squeegee 30 is not limited to any particular configuration or dimensions. In an example, the offset squeegee 30 may be adjustable.

Figure 7:
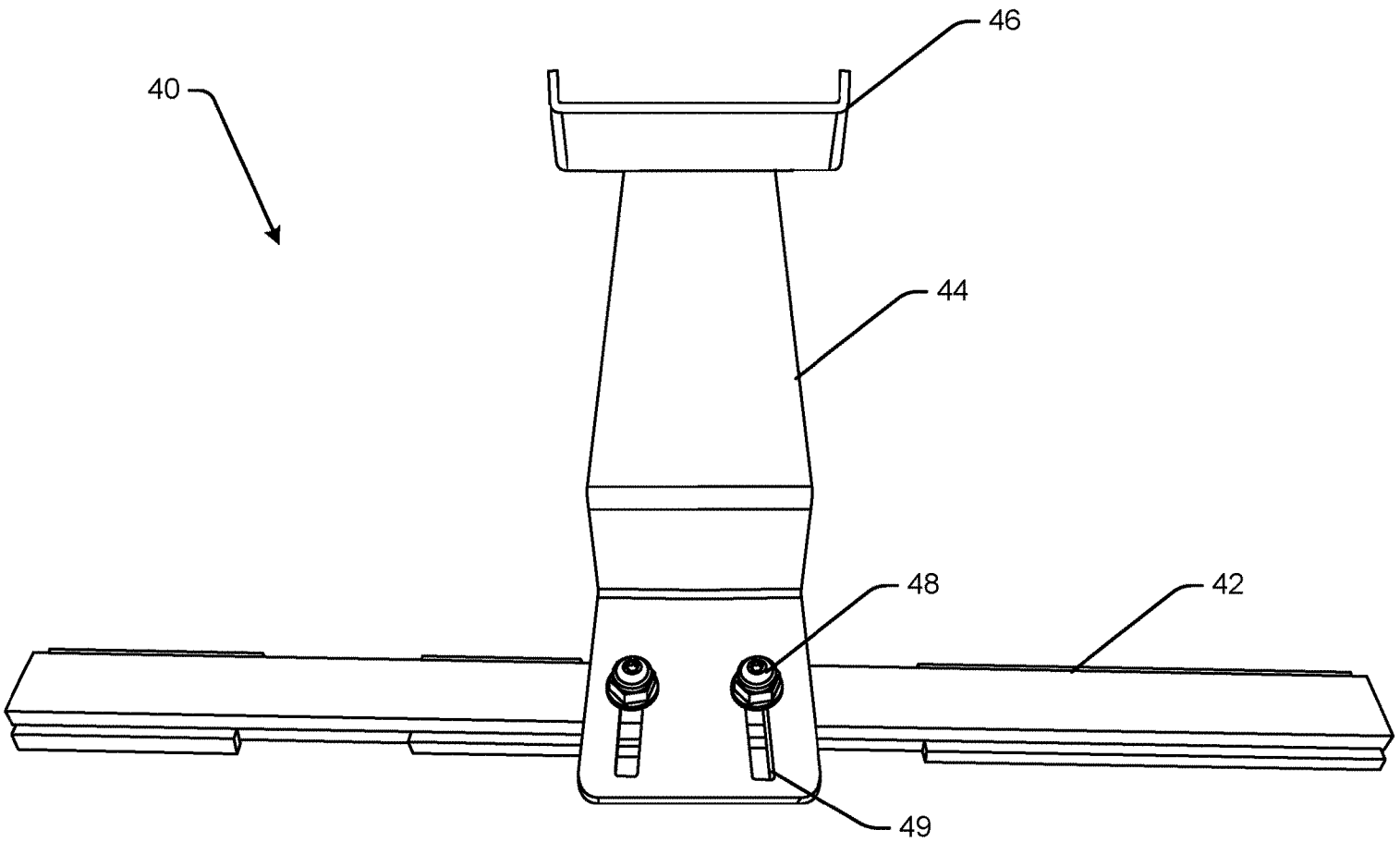
FIGS. 7-8 show an example offset flood bar of the screen printing device.
Figure 8:
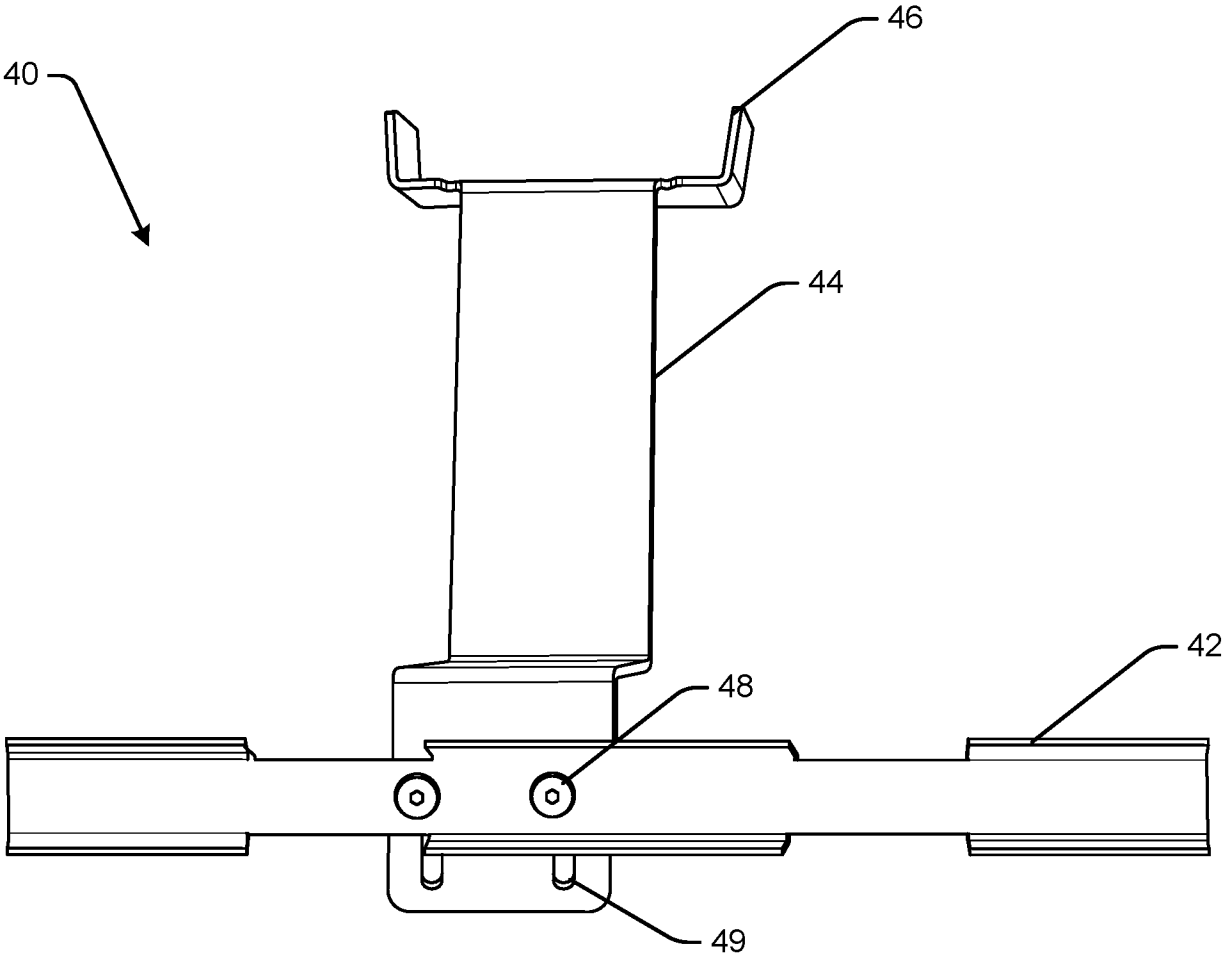

FIGS. 7-8 show an example offset flood bar 40 of the screen printing device. The example offset flood bar 40 has a mounting bar 42, offset bracket 44, and flood portion 46. The example offset squeegee 30 is not limited to any particular configuration or dimensions. In an example, the offset squeegee 30 may be adjustable via screws 48 and slots 49.

FIGS. 5 and 7 show a bottom ("looking up") view of the offset squeegee 30 and offset flood bar 40, respectively. FIGS. 6 and 8 show a top ("looking down") view of the offset squeegee 30 and offset flood bar 40, respectively. The offset squeegee 30 and the offset flood bar 40 may be mounted on a rail.

Figure 9:
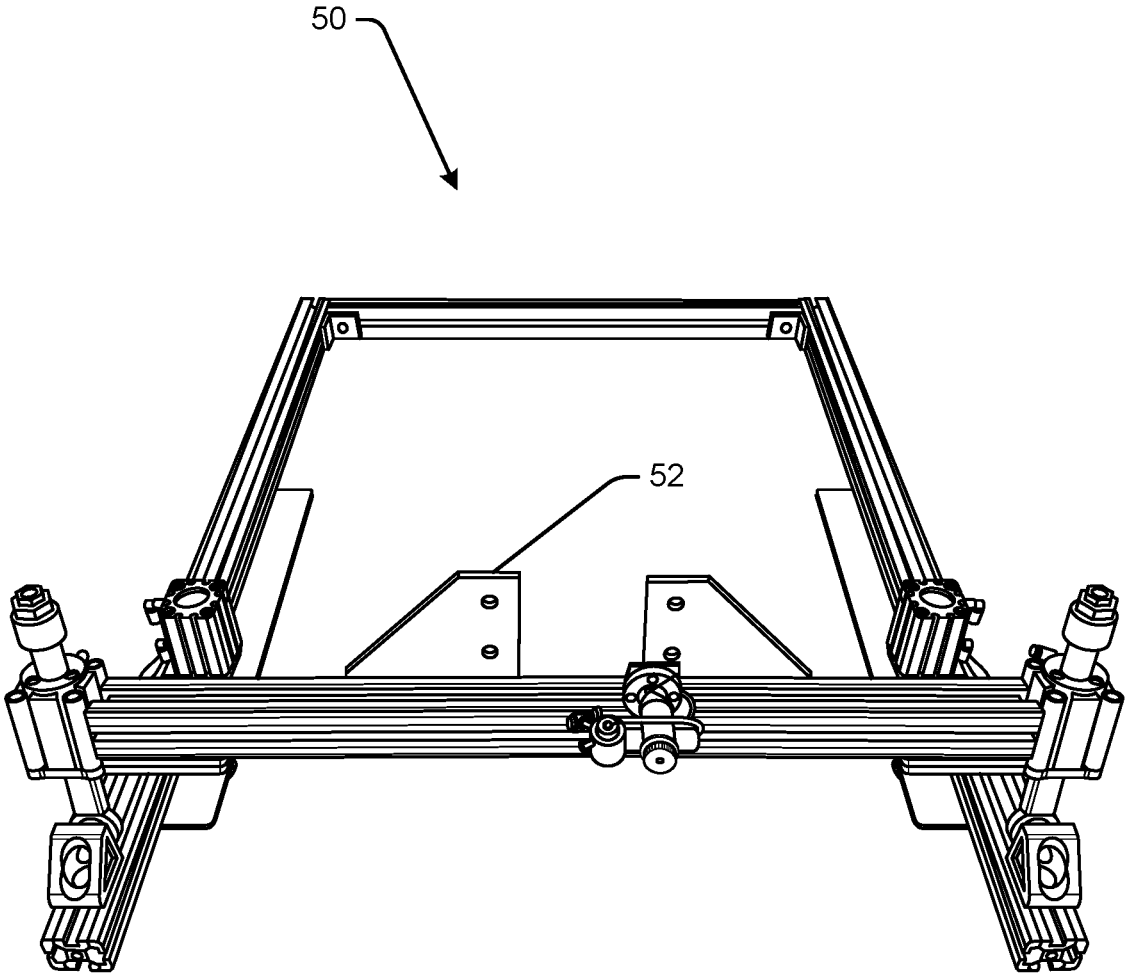
FIG. 9 shows an example rail for mounting an offset squeegee and flood bar to the printing machine.

FIG. 9 shows an example rail 50 for mounting the offset squeegee 30 and offset flood bar 40 to the printing machine. The rail 50 may be mounted to the printing machine. The offset squeegee 30 and offset flood bar 40 may be mounted to the rail, e.g., to brackets 52. The example rail 50 is not limited to any particular configuration or dimensions. In an example, the rail 50 may be adjustable.

Figure 10:
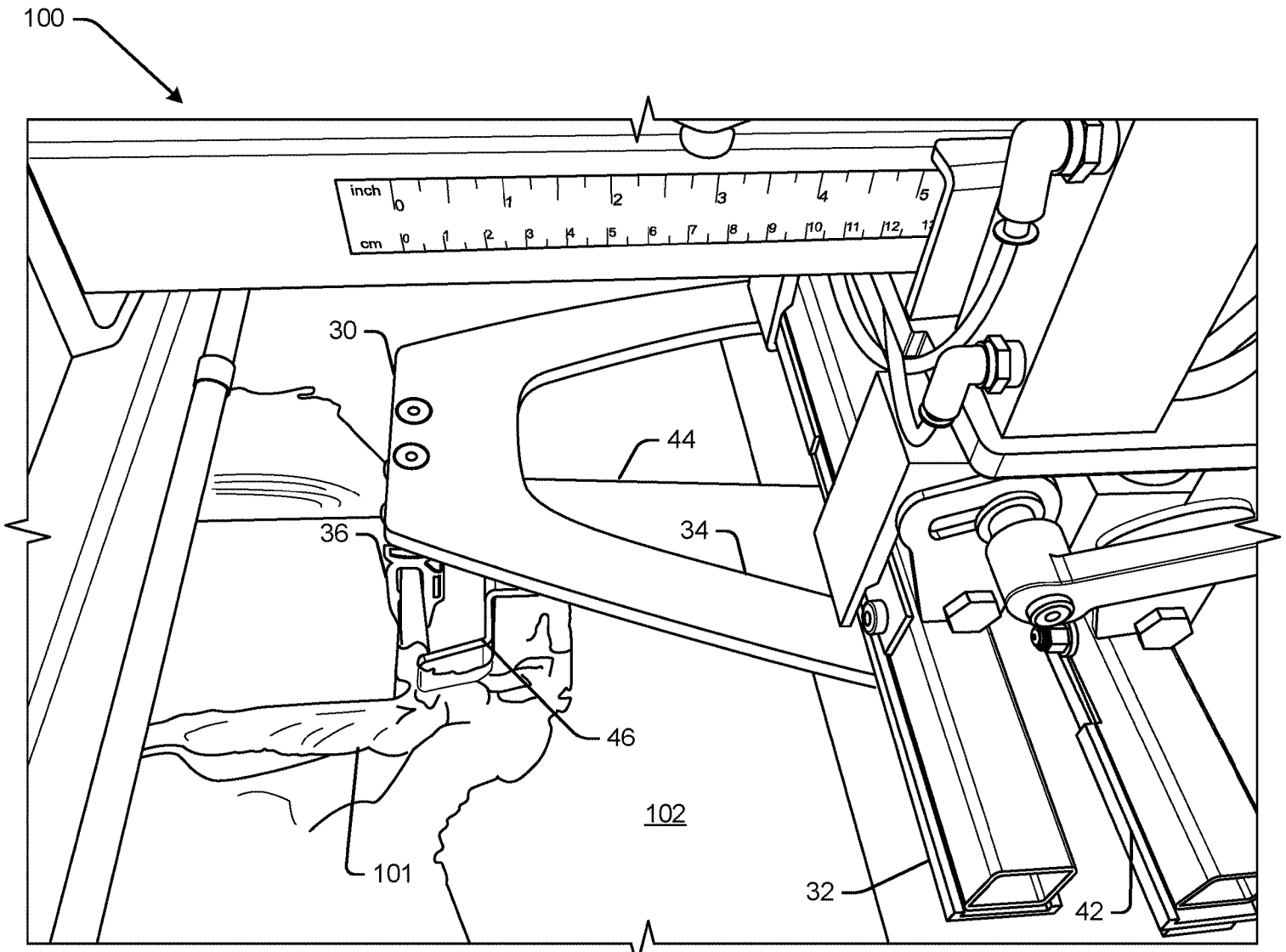
FIGS. 10-17 illustrate example printing operations implementing the screen printing device.
Figure 11:
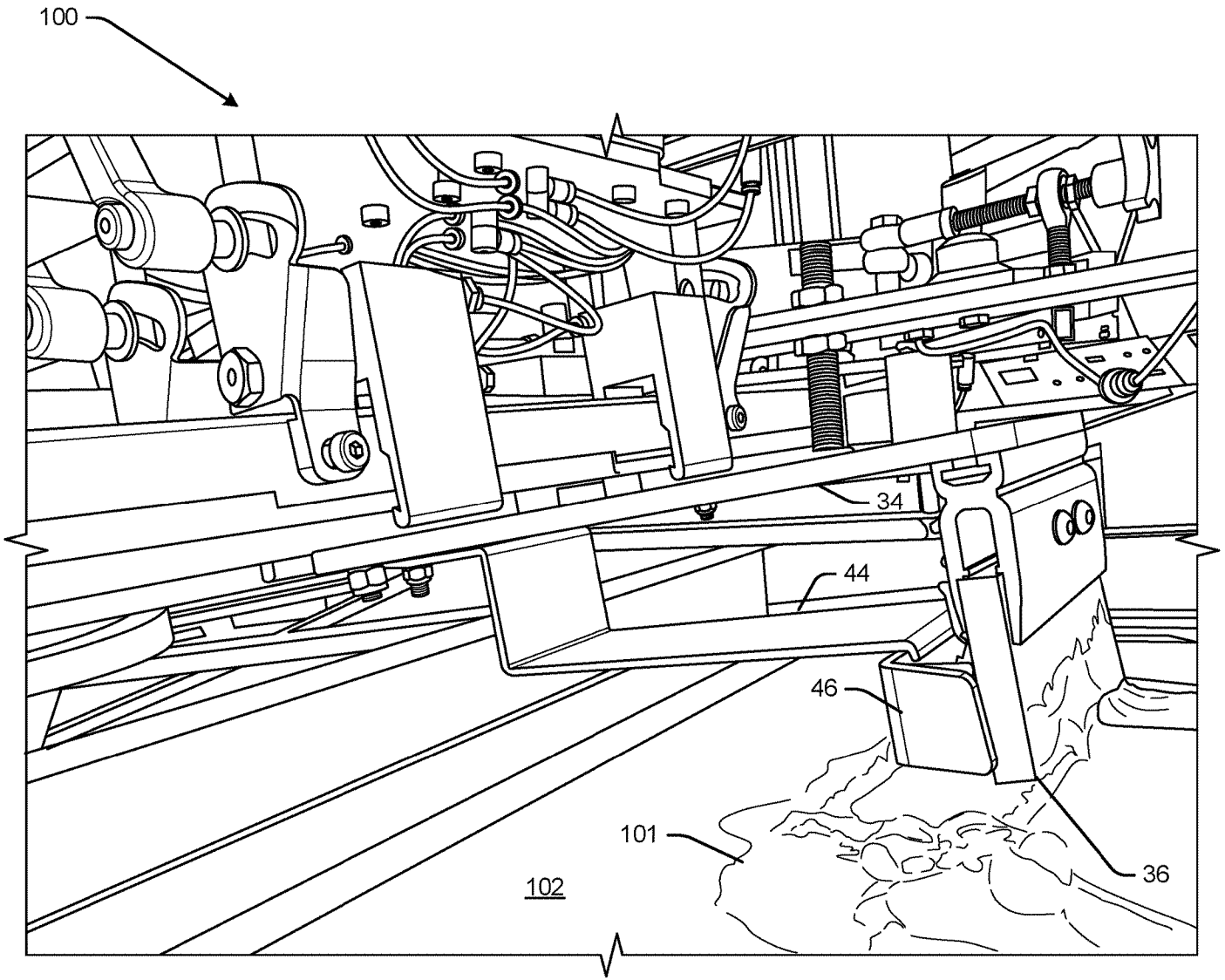

FIGS. 10-17 illustrate example printing operations implementing the screen printing device. In FIGS. 10 and 11, the shirt 4 is loaded onto the platen 10 and positioned in the print machine 100 under a screen 102. Ink 101 is provided on the screen 102, and the offset squeegee 30 and offset flood bar 40 pull the ink 101 over the screen 102 such that the ink moves through the screen to print in the label or tag area of the shirt 4. The operations shown and described herein are provided to illustrate example implementations. It is noted that the operations are not limited to the ordering shown. Still other operations may also be implemented.

Figure 12:
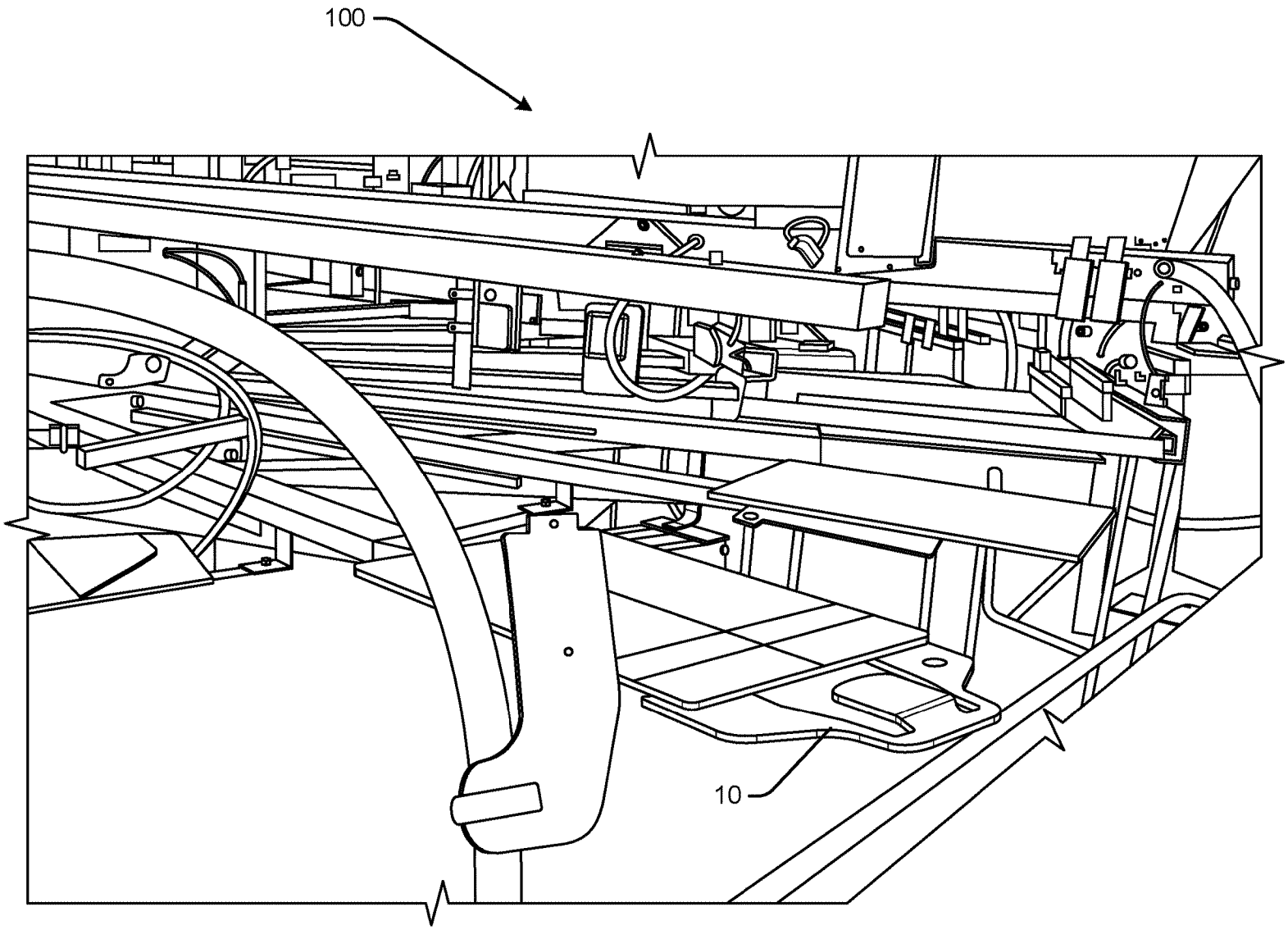
Figure 13:
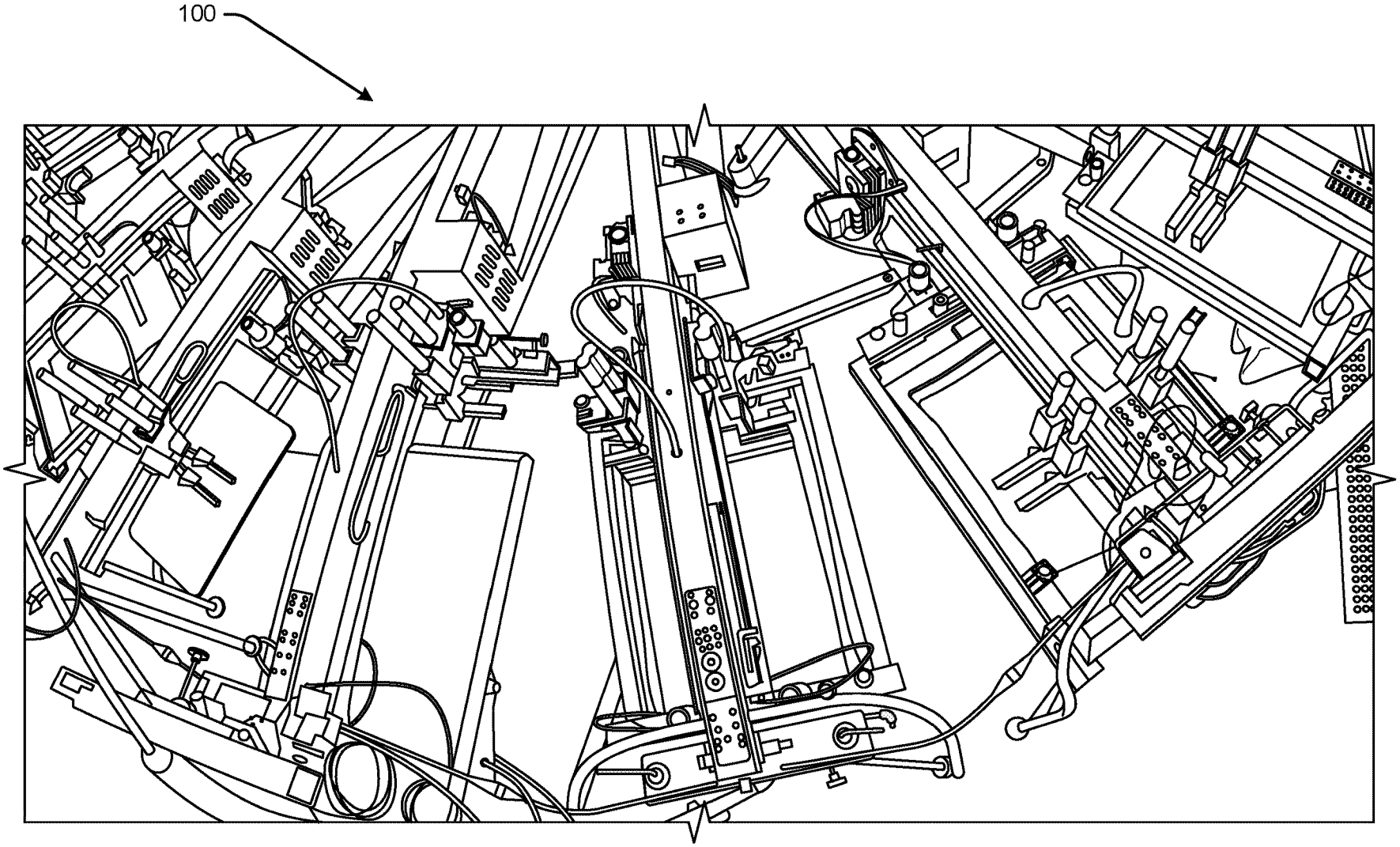

The printing machine 100 may be configured with a plurality of printheads or "stations" as can be seen in FIGS. 12 and 13. See also adjacent printheads or stations 110 and 112 in FIG. 16. The printheads may be configured in a circle so that the platens are rotated about the circle to each station for a print operation. Each station may be configured for an individual printing operation. For example, each of a plurality of printheads may be configured to print an individual color of a multicolor image on a chest area of a shirt 4. In addition, one or more of the printheads may be configured to print in the label or tag area of the shirt (e.g., inside shirt collar).

Figure 17:
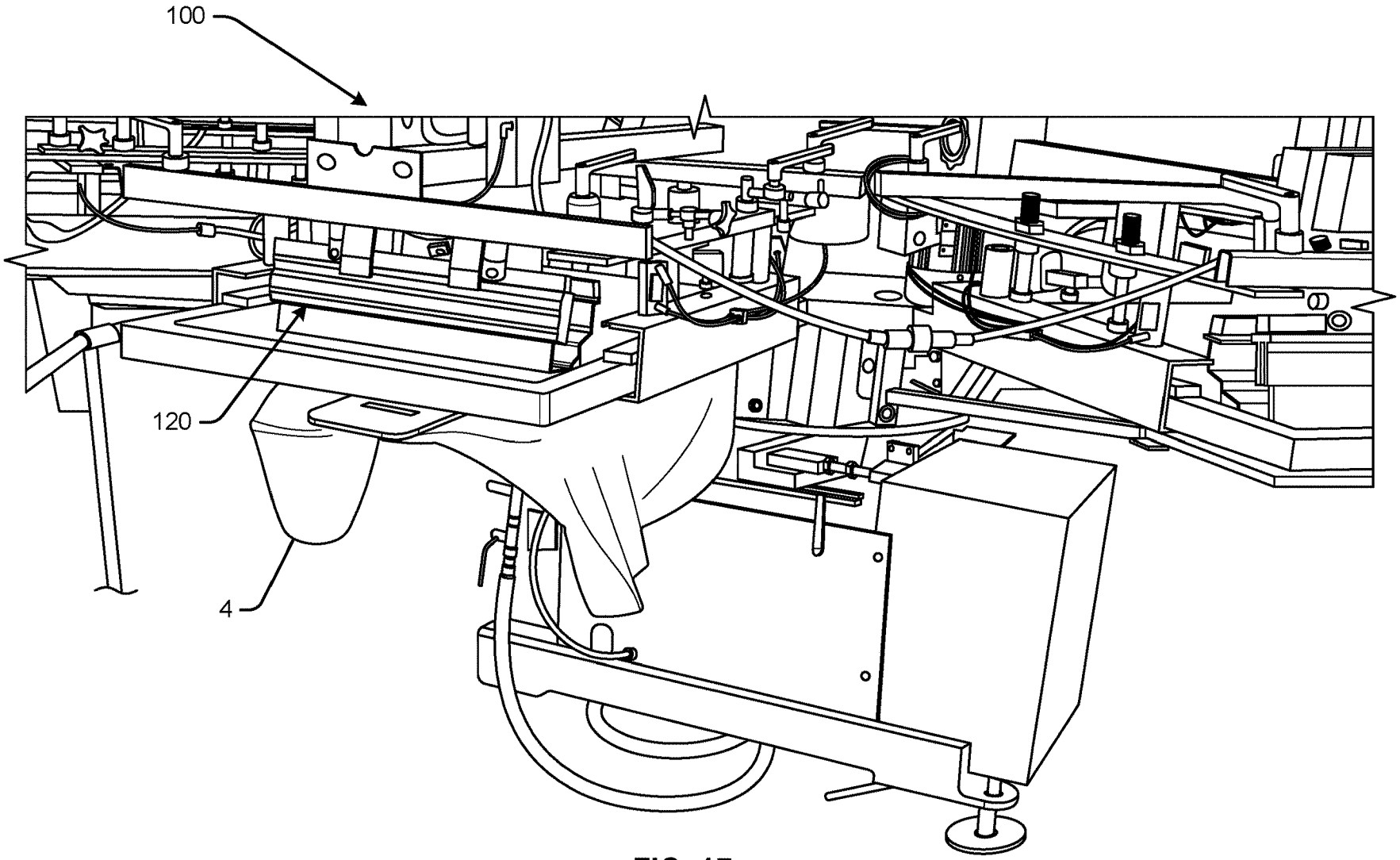

In an example, the printheads for printing on the chest area may be configured with a traditional squeegee and flood bar (e.g., squeegee 120 in FIG. 17). The station(s) for printing in the label or tag area of the shirt may be configured for a print operation with the offset squeegee (e.g., FIGS. 5-6) and offset flood bar (e.g., FIGS. 7-8).

The shirt may be loaded onto the platen (e.g., platen 10 in FIGS. 1-3) and moved (e.g., rotated when the print machine is configured with stations in a circle) between the various stations for printing on the shirt 4.

Figure 14:
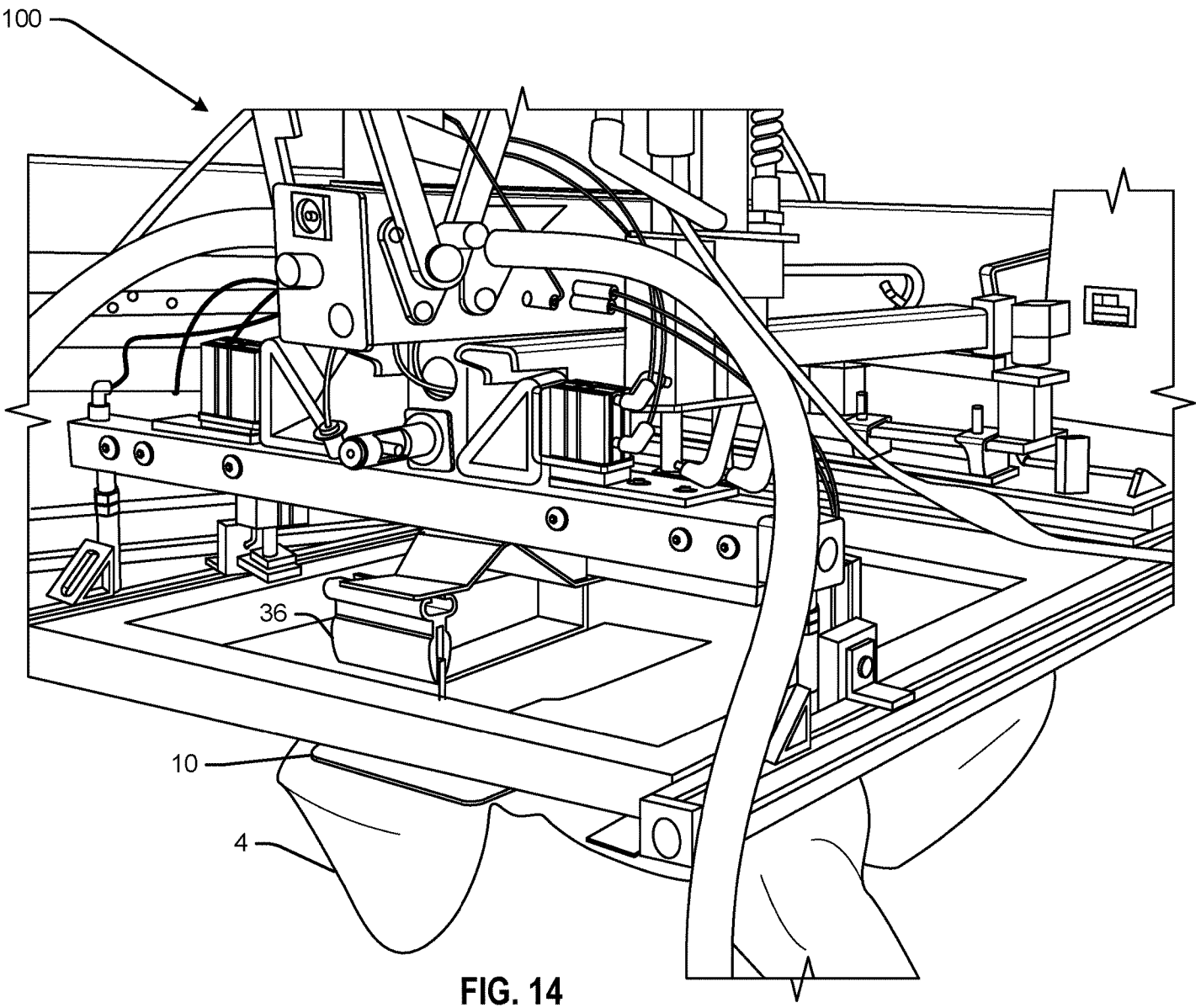
Figure 15:
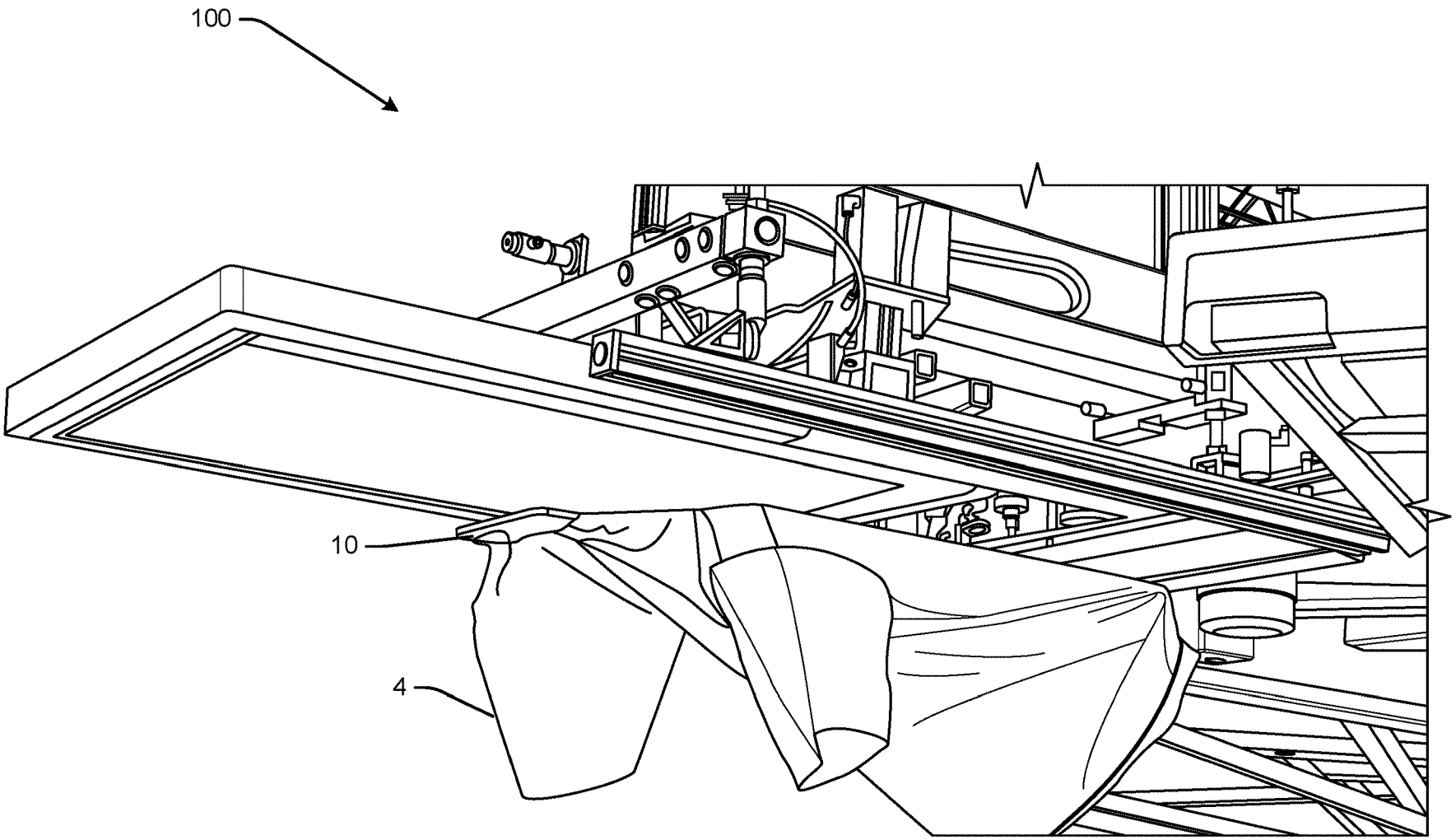

In an example, the printing machine may be configured with at least a first station for printing on the label or tag area of the shirt, as seen in FIGS. 14-15. The first station may have a first frame and image screen in a first position. For example, the first frame and image screen may be mounted to the rail 50 for mounting on the printing machine.

Figure 16:
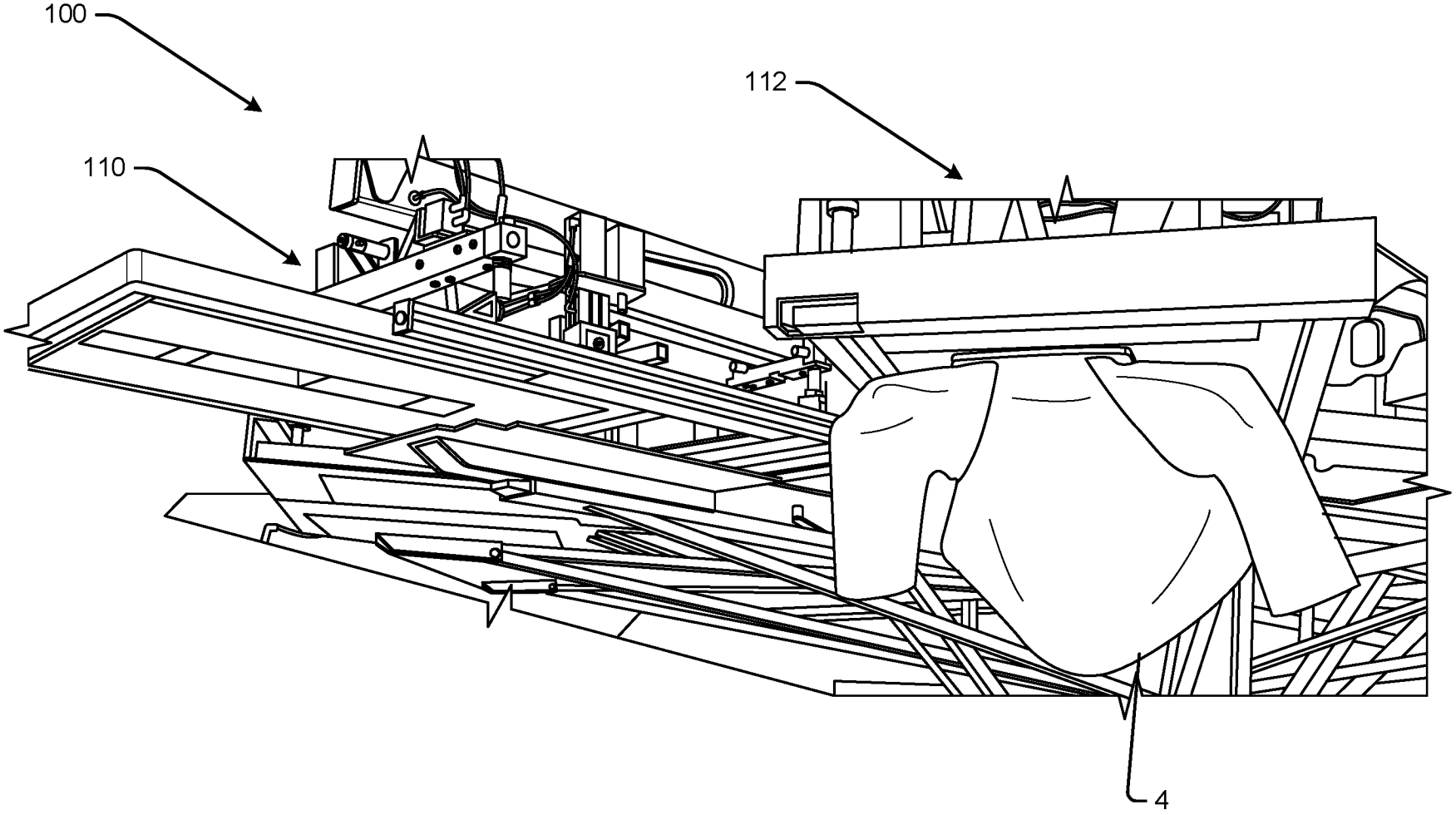

The printing machine may also be configured with at least a second station for printing on the chest area of the shirt, as seen in FIGS. 16-17. The second frame and image screen is configured for mounting in a second position for printing on a second print station of the printing machine in the chest image printing area.

In an example, the first position is farther away from the center of the printing machine (e.g., with stations configured in a circle as shown in part in FIGS. 12-13) than the second position which is closer in toward the center of the printing machine. This enables printing in the label or tag area of the shirt utilizing the extended platen 10. It is noted that not all printing machines are configured to operate in a circle. But regardless of the printing machine configuration, the station for printing in the label or tag area with the offset squeegee and offset floodbar will be configured to accommodate this print area.

Figure 18:
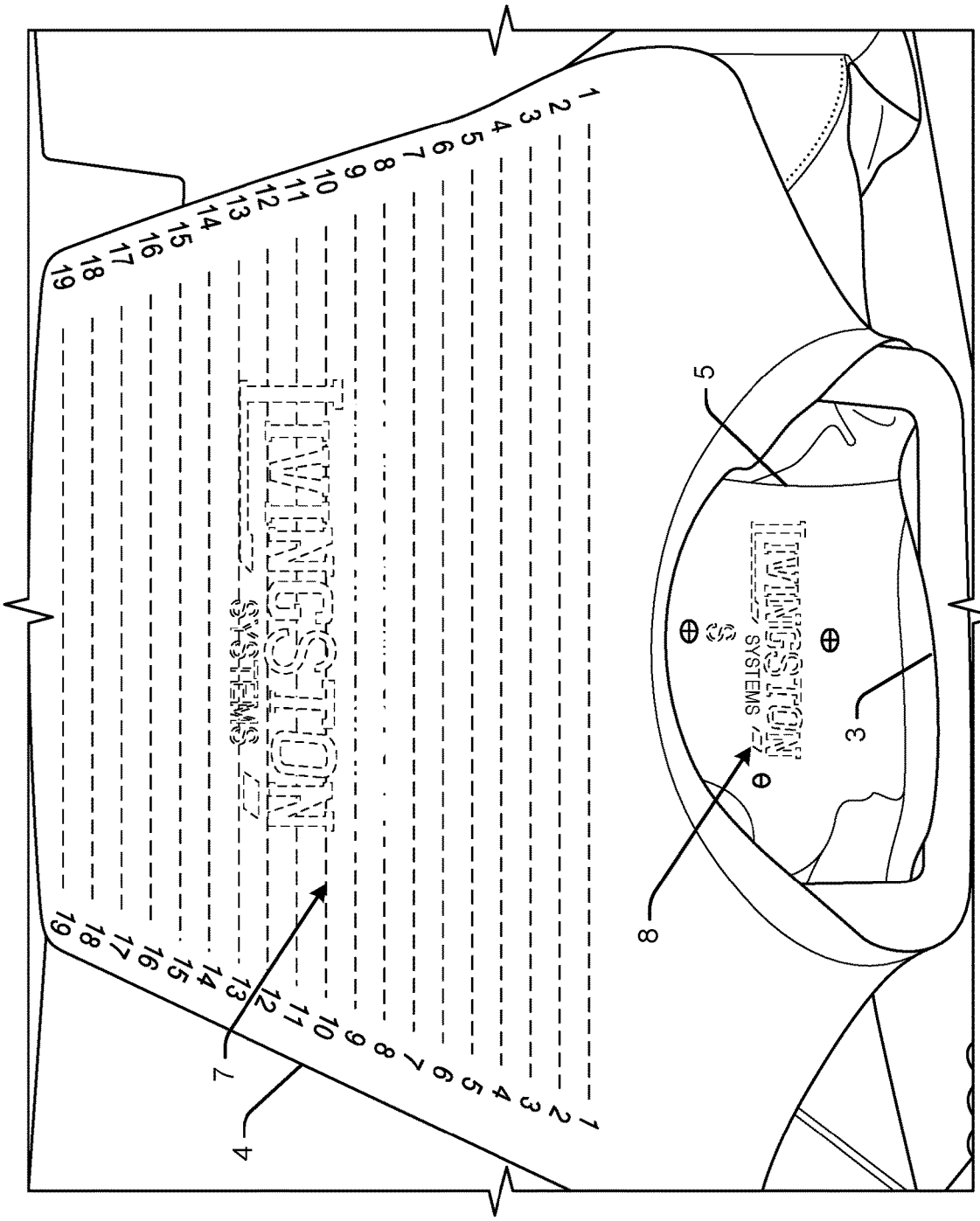
FIG. 18 shows an example shirt with a chest image and label printed by the screen printing device.

It can be seen in these figures that the printing machine was able to print on both the tag or label area of the shirt 4 (FIGS. 14-15), and separately on the chest of the shirt (FIGS. 16-17). FIG. 18 shows an example shirt 4 mounted to the platen 10 for a printing operation in the print machine described above. In this figure, the shirt 4 has been printed with a chest image 7 and shirt label or tag 8. It can be seen by the row height and width in this illustration, that the printing area on the chest of the shirt is not limited by the label printing area.

It is noted that the examples shown and described are provided for purposes of illustration and are not intended to be limiting. Still other examples are also contemplated.

The invention claimed is:

1. A screen printing device, comprising:

a screen printing pallet having a chest image printing surface connected to a label printing surface for printing on an inside collar of a shirt, the label printing surface extending outside of a chest image printing area of a printing machine when the screen printing pallet is loaded onto the printing machine;

a first squeegee configured for a first image printing operation on an outside chest area of the shirt; and a second squeegee that is offset from the first squeegee, the second squeegee configured for a second printing operation by the printing machine, the second printing operation separate from the first image printing operation to print on the inside collar of the shirt on the label printing surface.

2. The screen printing device of claim 1, further comprising a first frame and image screen configured for mounting in a first position for printing on a first print station of the printing machine on the label printing surface.

3. The screen printing device of claim 2, further comprising a rail for mounting on the printing machine, the rail configured to provide an offset stroke for the printing operation.

4. The screen printing device of claim 3, wherein the offset stroke has an offset start position.

5. The screen printing device of claim 3, wherein the offset stroke has an offset stop position.

6. The screen printing device of claim 3, wherein the offset stroke designates a travel path for the squeegee on the label printing surface during the printing operation on the first print station.

7. The screen printing device of claim 2, further comprising a second frame and image screen configured for mounting in a second position for printing on a second print station of the printing machine in the chest image printing area.

8. The screen printing device of claim 7, wherein the first position is farther away from a center of the printing machine than the second position.

9. The screen printing device of claim 2, wherein the first frame and image screen is clamped on a side to the first print station of the printing machine.

10. The screen printing device of claim 1, further comprising an offset flood bar configured for a printing operation by the printing machine on the label printing surface.

11. The screen printing device of claim 1, further comprising an upper plane corresponding to the chest image printing surface, and a lower plane corresponding to the label printing surface.

12. The screen printing device of claim 11, wherein the upper plane is about ⅛ inch higher than the lower plane.

13. A screen printing device, comprising:

a screen printing pallet for a printing machine;

a chest image printing surface of the screen printing pallet;

a separate label printing surface of the screen printing pallet for printing on an inside shirt collar, the label printing surface connected to the chest image printing surface such that the label printing surface is outside of the chest printing surface when the screen printing pallet is loaded onto the printing machine, wherein the printing machine is configured to print only in the chest image printing area during a chest printing operation, and the printing machine is configured to print only on the label printing surface during a separate label printing operation;

an upper plane corresponding to the chest image printing surface, and a lower plane corresponding to the label printing surface;

an offset squeegee configured for the label printing operation by the printing machine on the label printing surface; and an offset flood bar configured for the label printing operation by the printing machine on the label printing surface.

14. The screen printing device of claim 13, further comprising a first frame and image screen configured for mounting in a first position for printing on a first print station of the printing machine on the label printing surface.

15. The screen printing device of claim 14, further comprising a rail for mounting on the printing machine, the rail configured to provide an offset stroke for the printing operation.

16. The screen printing device of claim 15, wherein the offset stroke has an offset start position.

17. The screen printing device of claim 15, wherein the offset stroke has an offset stop position.

18. The screen printing device of claim 15, wherein the offset stroke designates a travel path for the squeegee on the label printing surface during the printing operation on the first print station.

19. The screen printing device of claim 14, further comprising a second frame and image screen configured for mounting in a second position for printing on a second print station of the printing machine in the chest image printing area, wherein the first position is farther away from a center of the printing machine than the second position.

20. The screen printing device of claim 14, wherein the first frame and image screen is clamped on a side to the first print station of the printing machine.

* * * * *